US011130623B2

(12) United States Patent
Poppe et al.

(10) Patent No.: US 11,130,623 B2
(45) Date of Patent: Sep. 28, 2021

(54) VALVE FOR A CONTAINER

(71) Applicant: Altachem NV, Harelbeke (BE)

(72) Inventors: Jean-Marie Poppe, Heule (BE); Niels Vanlerberghe, Machelen Zulte (BE)

(73) Assignee: Altachem NV, Harelbeke (BE)

( * ) Notice: Subject to any disclaimer, the term of this patent is extended or adjusted under 35 U.S.C. 154(b) by 0 days.

(21) Appl. No.: 16/649,431

(22) PCT Filed: Sep. 20, 2018

(86) PCT No.: PCT/EP2018/075519
§ 371 (c)(1),
(2) Date: Mar. 20, 2020

(87) PCT Pub. No.: WO2019/057842
PCT Pub. Date: Mar. 28, 2019

(65) Prior Publication Data

US 2020/0239222 A1 Jul. 30, 2020

(30) Foreign Application Priority Data

Sep. 21, 2017 (BE) ..... 2017/5671

(51) Int. Cl.
*B65D 83/48* (2006.01)
*B65D 83/38* (2006.01)
(Continued)

(52) U.S. Cl.
CPC ..... *B65D 83/48* (2013.01); *B65D 83/38* (2013.01); *B05B 11/3077* (2013.01);
(Continued)

(58) Field of Classification Search
CPC ..... B65D 83/38; B65D 83/42–425; B65D 83/46; B65D 83/48; B65D 83/52–546; B05B 11/3077
See application file for complete search history.

(56) References Cited

U.S. PATENT DOCUMENTS 2,869,764 A * 1/1959 Collins ..... B65D 83/46 222/402.23
2,889,086 A * 6/1959 Collins ..... B65D 83/46 222/402.22
(Continued)

FOREIGN PATENT DOCUMENTS

CA 2 682 061 C 4/2010
DE 44 26 730 A1 2/1996
(Continued)

OTHER PUBLICATIONS

International Search Report in PCT/EP2018/075519, dated Dec. 3, 2018.

*Primary Examiner* — Paul R Durand
*Assistant Examiner* — Randall A Gruby
(74) *Attorney, Agent, or Firm* — Collard & Roe, P.C.

(57) ABSTRACT

A valve for a container for dispensing pressurized fluid includes a housing which is mounted on a valve cup, a hollow stem provided in a passage of the housing which stem has at least one lateral inlet opening at its lower end and an outlet opening at its upper end, and a spring. The housing has a circumferential step-like contour with an outer, lower part and a central, upper part. The valve cup follows essentially the step-like contour line of the housing and ends horizontally on the top of the housing close to the stem and a sealing is provided on the upper side of the housing between the housing and the valve cup and which seals at the same time the valve cup against the housing and the stem against the housing.

8 Claims, 12 Drawing Sheets

SECTION B-B

(51) Int. Cl.

| | |
|---|---|
| *B05B 11/00* | (2006.01) |
| *B65D 83/20* | (2006.01) |
| *B65D 83/30* | (2006.01) |
| *B65D 83/32* | (2006.01) |

(52) U.S. Cl.
CPC ..... *B65D 83/206* (2013.01); *B65D 83/303* (2013.01); *B65D 83/32* (2013.01)

(56) References Cited

U.S. PATENT DOCUMENTS

| | | | | | |
|---|---|---|---|---|---|
| 2,994,461 | A * | 8/1961 | Michel | B65D 83/46 | 222/153.11 |
| 3,249,261 | A * | 5/1966 | Einar | B65D 83/46 | 222/190 |
| 3,572,557 | A * | 3/1971 | Graham | B65D 83/14 | 222/402.22 |
| 3,583,608 | A * | 6/1971 | Green | B65D 83/44 | 222/402.24 |
| 3,593,895 | A * | 7/1971 | Green | B65D 83/14 | 222/402.24 |
| 3,612,361 | A * | 10/1971 | Ewald | B05B 7/1245 | 222/402.18 |
| 3,612,362 | A * | 10/1971 | Champagne | B65D 83/66 | 222/402.24 |
| 3,620,422 | A * | 11/1971 | Webster | B65D 83/46 | 222/402.22 |
| 3,633,798 | A * | 1/1972 | Webster | B65D 83/46 | 222/402.22 |
| 3,637,114 | A * | 1/1972 | Meshberg | B65D 83/682 | 222/135 |
| 3,653,558 | A * | 4/1972 | Shay | B65D 83/44 | 222/402.17 |
| 3,674,186 | A * | 7/1972 | Ewald | B65D 83/682 | 222/402.21 |
| 3,756,476 | A * | 9/1973 | Bonduris | B65D 83/62 | 222/386.5 |
| 3,774,810 | A * | 11/1973 | Corsette | B65D 83/60 | 222/146.1 |
| 3,791,561 | A * | 2/1974 | Ewald | B65D 83/70 | 222/396 |
| 3,813,013 | A * | 5/1974 | Kotuby | B65D 83/54 | 222/402.2 |
| 3,893,653 | A * | 7/1975 | Kolanus | B65D 83/48 | 251/353 |
| 4,078,705 | A * | 3/1978 | Butcher | B65D 83/425 | 222/402.24 |
| 4,139,128 | A * | 2/1979 | Ewald | B65D 83/44 | 222/402.17 |
| 4,247,024 | A * | 1/1981 | Vogel | B65D 83/425 | 222/402.16 |
| 4,258,904 | A * | 3/1981 | Scremin | B65D 83/425 | 222/322 |
| 4,418,847 | A * | 12/1983 | Beard | B65D 83/46 | 222/402.23 |
| 4,702,400 | A * | 10/1987 | Corbett | G01F 11/32 | 222/402.2 |
| 4,826,054 | A * | 5/1989 | Frutin | B65D 83/201 | 222/402.11 |
| 4,858,790 | A * | 8/1989 | Howlett | B65D 83/54 | 222/402.2 |
| 5,397,059 | A * | 3/1995 | Baudin | B05B 7/066 | 239/333 |
| 5,605,258 | A * | 2/1997 | Abplanalp | B65D 83/48 | 222/402.1 |
| 5,632,421 | A * | 5/1997 | Colombo | B65D 83/38 | 222/402.2 |
| 5,762,319 | A | 6/1998 | Kopp | | |
| 5,904,274 | A * | 5/1999 | Warby | B65D 83/54 | 222/402.2 |
| 5,927,563 | A * | 7/1999 | Kellner | B65D 83/48 | 222/402.1 |
| 5,938,085 | A * | 8/1999 | Conroy | B65D 83/54 | 222/402.2 |
| 6,058,960 | A * | 5/2000 | Kopp | B65D 83/48 | 137/68.11 |
| 6,318,603 | B1 * | 11/2001 | Burt | B65D 83/54 | 222/402.1 |
| 6,371,338 | B1 * | 4/2002 | Klein | B65D 83/48 | 222/402.1 |
| 6,581,806 | B2 * | 6/2003 | Lilienthal | B05C 17/015 | 141/20 |
| 6,619,515 | B1 * | 9/2003 | Abplanalp | B65D 83/46 | 222/402.21 |
| 8,074,848 | B2 | 12/2011 | Pittl et al. | | |
| 8,371,481 | B2 | 2/2013 | Kopp | | |
| 8,800,824 | B2 * | 8/2014 | Ganan-Calvo | B65D 83/34 | 222/402.18 |
| 8,905,273 | B2 * | 12/2014 | de Schrijver | B65D 83/756 | 222/402.21 |
| 10,633,167 | B2 * | 4/2020 | Kim | B65D 83/48 | |
| 10,640,282 | B2 * | 5/2020 | Ehrensperger | B65D 83/22 | |
| 2002/0190085 | A1 * | 12/2002 | Stanford | B65D 83/54 | 222/402.1 |
| 2005/0121476 | A1 | 6/2005 | Pauls et al. | | |
| 2009/0261130 | A1 | 10/2009 | Pittl et al. | | |

FOREIGN PATENT DOCUMENTS

| | | | |
|---|---|---|---|
| DE | 10 2008 051888 | A1 | 4/2010 |
| DE | 10 2008 019 224 | B4 | 9/2010 |
| EP | 2 110 339 | A1 | 10/2009 |
| WO | 03/062092 | A1 | 7/2003 |
| WO | 2014/199182 | A1 | 12/2014 |

* cited by examiner

SECTION A-A

SECTION B-B

SECTION A-A

SECTION B-B

SECTION A-A

SECTION B-B

VALVE FOR A CONTAINER

CROSS REFERENCE TO RELATED APPLICATIONS

This application is the National Stage of PCT/EP2018/075519 filed on Sep. 20, 2018, which claims priority under 35 U.S.C. § 119 of Belgium Application No. BE2017/5671 filed on Sep. 21, 2017, the disclosure of which is incorporated by reference. The international application under PCT article 21(2) was published in English.

BACKGROUND OF THE INVENTION

1. Field of the Invention

The invention concerns a valve for a container for dispensing pressurized fluid, said valve comprising a housing which is mounted on a valve cup, a hollow stem provided in a passage of the housing which stem has at least one lateral inlet opening at its lower end and an outlet opening at its upper end, which stem is displaceable between a closed position and an open position and spring means by means of which the stem is pushed in the closed position, wherein the housing has a circumferential step-like contour with an outer, lower part and a central, upper part.

2. Description of the Related Art

CA 2 682 061 C describes a valve for a container of this type. The housing of this valve has a circumferential step-like contour line and the inner end of the valve cup ends horizontally at the base of the outer lower part of the housing where it is rigidly connected to the base of the housing. The inner part of the valve cup is inserted into the structure of the housing below the lower part thereof. However, the rigid and sealing connection between the base of the housing and the valve cup is difficult to achieve and a second sealing must be provided between the stem and the housing.

DE 10 2008 019 224 B4 also concerns a valve assembly for a pressurized fluid container of this type. The housing of this valve has a circumferential step-like contour line with a circumferential protrusion on the outer lower part of the housing against which abuts the vertical inner part of the valve cup.

WO 2014/199182 A1 describes a fluid dispensing apparatus comprising an elongate valve member having a fluid outlet and a fluid inlet locatable in fluid communication with a fluid reservoir.

WO 03/062092 A1 concerns a valve for discharging foaming agents from pressurized containers. Sealing is provided by an elastic element that is located on the valve face.

Crimping of components is a well-known technique in the aerosol industry.

It is known in the field of dispenser valves that water vapour entering into the container can deteriorate the content of the container and lead to undesirable chemical reactions thereof. In the case of polyurethane containers, the polyurethane reacts with the water vapour which leads to the sticking of the dispenser valve.

It is therefore an object of the present invention to provide a valve, in particular for dispensing foam, with a better and simpler sealing between the valve cup and the housing and between the stem and the housing thereby reducing as well gas loss during the filling and storage of the container as water vapour transition to the inside of the container.

This object is achieved according to the invention by a valve in which the valve cup follows essentially the step-like contour line of the housing and ends horizontally on the top of the housing close to the stem and wherein a sealing is provided on the upper side of the housing between the housing and the valve cup and which seals at the same time the valve cup against the housing and the stem against the housing, wherein the lower part of the housing situated in the container is provided with a circumferential groove in which a spring element, preferably a metallic spring element, is held which pushes the stem in the closed position.

The main advantages of these measures are the following. The invention results in a very robust valve with limited creep and minimal permeability, thereby reducing water vapour transfer and sticking to a minimum. The circumferential step-like contour confers a high rigidity to the valve cup. The fact that the sealing seals at the same time the valve cup against the housing and the stem against the housing simplifies the assembly of the valve. In this context, it is preferred that the stem is free of split lines in the sealing area. For opening the valve, the stem must be pushed downwards with a force which is higher than the closing force of the metallic spring element. The spring element is therefore a limiting spring.

The closing speed of the valve is very high which is favourable during the filling since there is less gas loss during the filling procedure. The opening force keeps constant even over a long time of use of the valve.

According to a preferred embodiment of the invention, the valve cup is crimped around the housing.

This means that the valve cup is deformed with a crimping tool around the housing in order to fix it on the housing. The crimping tool may have indentations in order to improve the quality of crimping. Due to the mechanical tension which occurs during the crimping step, the sealing is fixed between the housing and the valve cup and at the same time around the stem. The crimping step which fixes the valve cup to the housing also confers a higher solidity to the valve cup.

According to a further embodiment, the stem is provided on its lower end situated in the container with a flange that abuts in the closed position against the housing thereby closing the passageway through the stem.

This is a very reliable solution for closing the passageway. The stem which is made of hard plastic material (such as high density polyethylene) abutting with its flange against the housing which is also made of hard plastic material results in a lower gas loss than conventional valves using rubber sealing.

According to one embodiment of the present invention, the flange of the stem abuts in the closed position against a flat part of the housing.

This solution provides sufficient sealing force for a multitude of applications.

One preferred embodiment is that the flange of the stem abuts in the closed position against a circular rib on the housing.

This solution provides a circular contact between the stem and the housing. Consequently, the sealing surface is smaller and consequently the sealing force per surface unit is higher than for the full surface contact between the flange of the stem and the housing.

According to a further preferred embodiment, the flange of the stem has a conically shaped flange that abuts in the closed position against a lipseal located on the housing.

This solution also provides a high sealing force since there is only a circular contact between the flange of the stem and the housing. The internal pressure causes an upward force onto the stem and the conical shape of the stem is pressed onto the lipseal located on the housing so that an efficient sealing is achieved between the stem and the lipseal of the housing.

Furthermore, according to the present invention, there may be a top sealing part provided around the outlet opening of the stem.

This top sealing part might be a part that is snapped on top of the stem or could alternatively be implemented into the stem (e.g. by two-component injection of hard and soft materials moulded together). It is the interface between the stem and an actuator or adapter which may be placed on the valve and it optimizes the interaction between the stem and an applicator placed on the valve, such as a foam gun or an actuator.

According to a further embodiment of the present invention, means are provided for limiting the opening distance of the valve.

These means, which can be in form of a specially designed spring which limits the opening distance of the valve and prevents the valve from being deformed, make sure that the valve is not opened beyond a maximum opening distance. These means prevent the valve from being overactivated when it is connected to an actuator.

The invention also concerns a method of producing a valve for a container for dispensing pressurized fluid, said valve comprising a housing which is mounted on a valve cup, a hollow stem provided in a passage of the housing which stem has at least one lateral inlet opening at its lower end and an outlet opening at its upper end, which stem is displaceable between a closed position and an open position and spring means by means of which the stem is pushed in the closed position, wherein the housing has a circumferential step-like contour with an outer, lower par and a central, upper part, comprising the steps of Providing a sealing on the upper side of the housing between the housing and the valve cup, Crimping the valve cup on the housing, wherein the valve cup follows essentially the step-like contour line of the housing and ends horizontally on the top of the housing close to the stem so that the sealing seals at the same time the valve cup against the housing and the stem against the housing.

This method is an economic way to produce a highly resistant valve and has advantages over known methods such as snapping (which is less reliable) or moulding (which might cause deformation due to the heat applied).

The valve according to the present invention is in particular designed for dispensing foam, preferably one or two component polyurethane foam.

BRIEF DESCRIPTION OF THE DRAWINGS

In the following, the invention is discussed more in detail with reference to preferred embodiments shown in the drawings in which.

DETAILED DESCRIPTION OF THE PREFERRED EMBODIMENTS

Figure 1A:
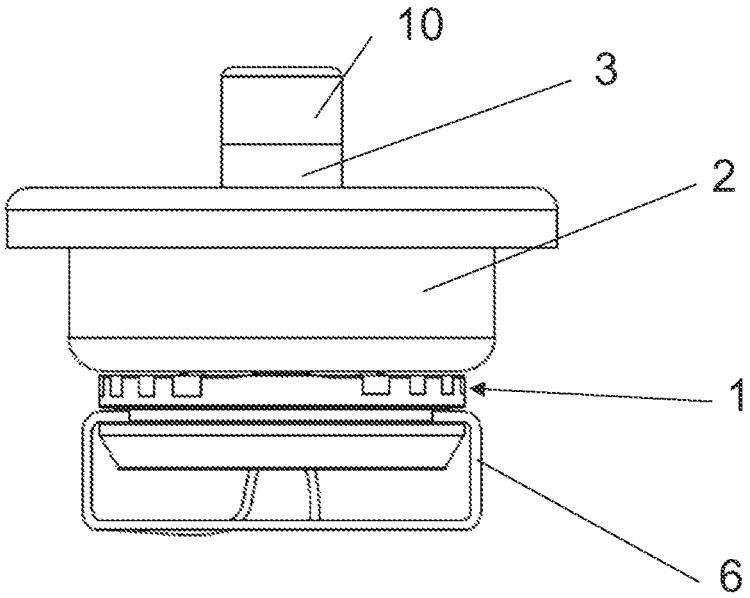
FIG. 1*a* and FIG. 1*b* show side views of a first embodiment of a valve according to the present invention in a closed position.
Figure 1B:
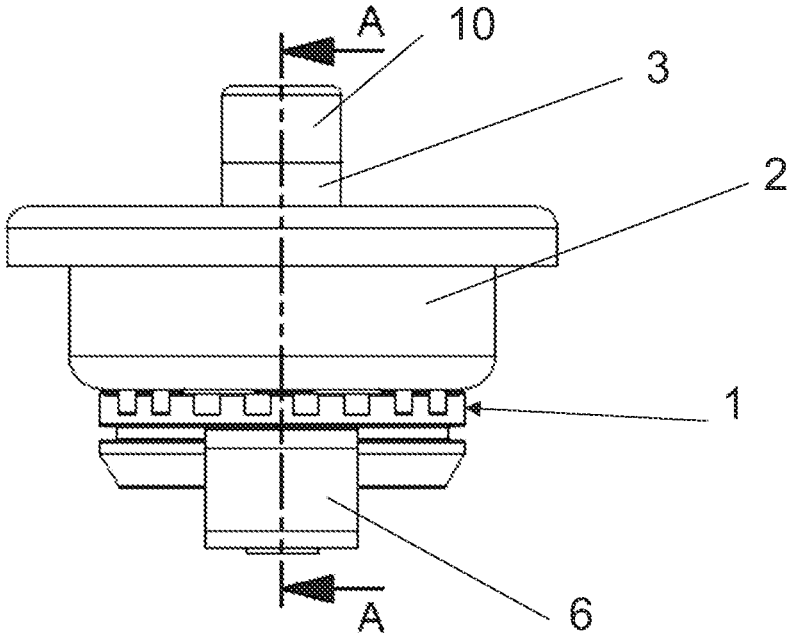
Figure 1C:
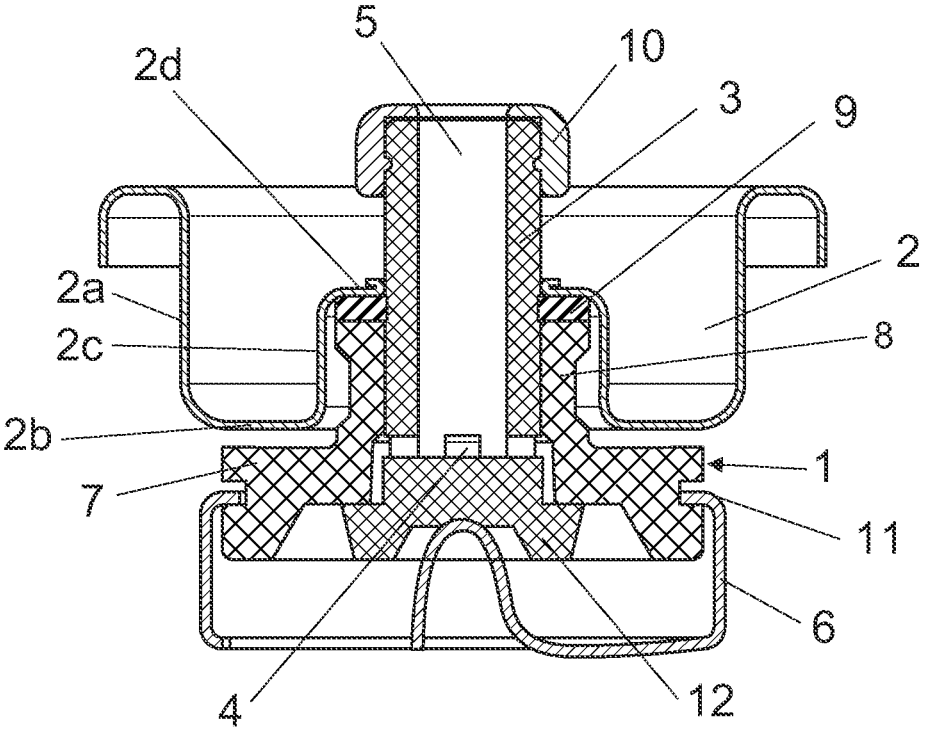
FIG. 1*c* shows a cut representation along lines A-A of FIG. 1*b* of the first embodiment in the closed position.
Figure 2A:
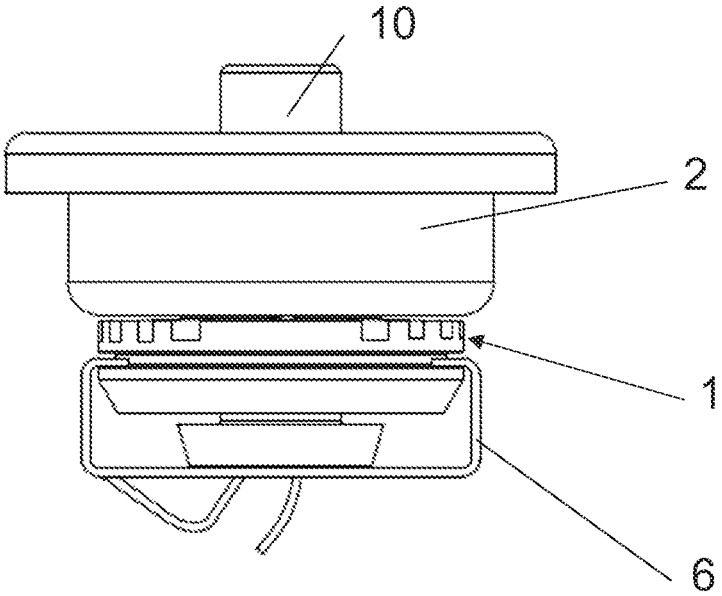
FIG. 2*a* and FIG. 2*b* show side views of the first embodiment in an open position.
Figure 2B:
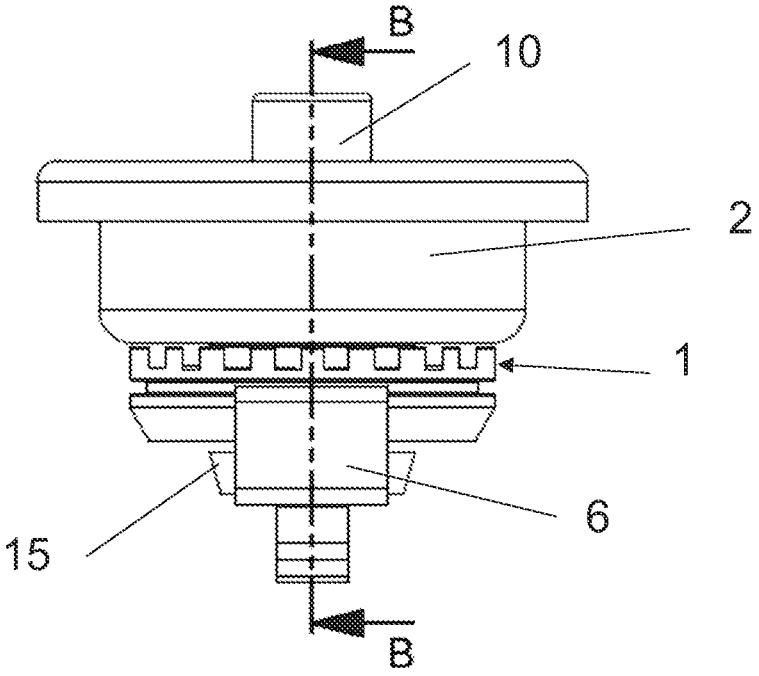
Figure 2C:
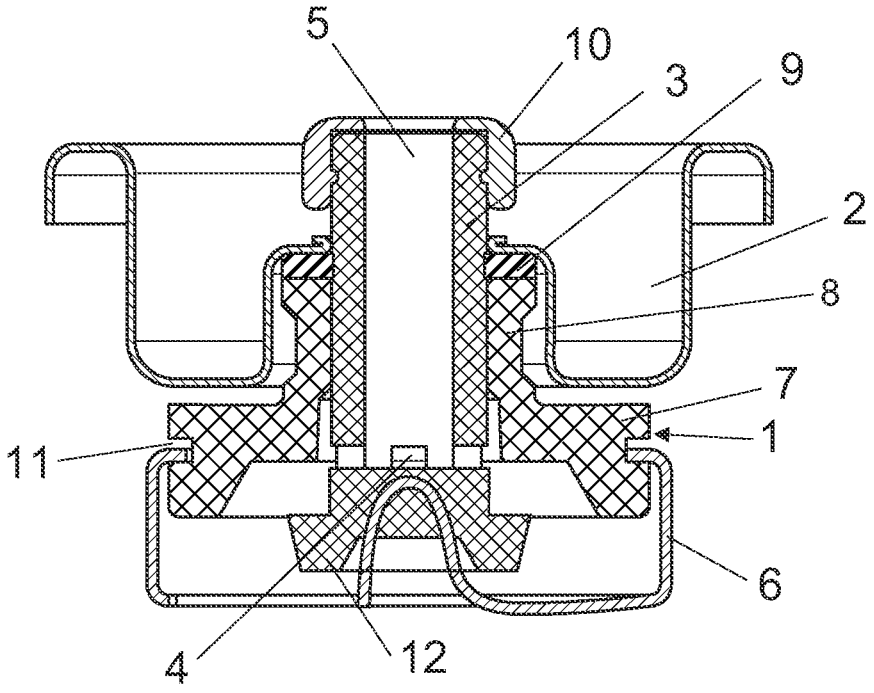
FIG. 2*c* shows a cut representation along lines B-B of FIG. 2*b* of the first embodiment in the open position.

The FIGS. 1*a* to 3*b* show a valve for a container for dispensing pressurized fluid, preferably foam, in particular one component or two component polyurethane foam.

The valve comprises a housing 1 which is mounted on a valve cup 2.

In a central passage of the housing 1 a hollow stem 3 is provided which has at least one lateral inlet opening 4 at its lower end and an outlet opening 5 at its upper end. The stem 3 is displaceable in the passage between a closed position and an open position.

The housing 1 has a circumferential step-like contour with an outer, lower part 7 and a central, upper part 8. According to the present invention, the valve cup 2 then follows essentially the step-like circumferential contour line of the housing 1 and ends horizontally on the top of the housing 1 close to the stem 3.

This will in the following be described more in detail. The outer end of the valve cup 2 is bended and thereby designed to be fixed to a container containing the pressurized fluid. The valve cup 2 then has a first vertical part 2*a* extending downwards and ending by a curb over the outer, lower part 7 of the housing. It can be seen from the figures that the valve cup 2 has a first horizontal part 2*b* extending to the centre of the valve which is essentially parallel to the upper side of the outer, lower part 7 of the housing 1. The valve cup 2 is then curbed again and has a second vertical part 2*c* extending upwards which is essentially parallel to the vertical side of the central, upper part 8 of the housing. At the end of this vertical part 2*c*, it is bended again and has a further horizontal part 2*d* extending to the centre of the valve. This further horizontal part 2*d* is essentially parallel to the upper side of the central, upper part 8 of the housing 1.

A sealing 9 is provided which seals at the same time the valve cup 2 against the housing 1 and the stem 3 against the housing 1. This sealing 9 is placed on the top of the central, upper part 8 of the housing 1.

The valve cup 2 is crimped around the housing 1. This crimping step deforms the area 2*c* and thereby fixes the valve cup 2 on the housing 1 and at the same time the sealing 9 in its position between the housing 1 and the valve cup 2 and the stem 3.

The stem 3 is pushed by spring means 6, here a metallic spring 6, in the closed position and can be opened against the force of the spring means 6. The lower part of the housing 1 situated in the container is provided with a circumferential groove 11 in which the metallic spring 6 is held.

A top sealing part 10 can be provided around the outlet opening 5 of the stem 3.

Figure 4A:
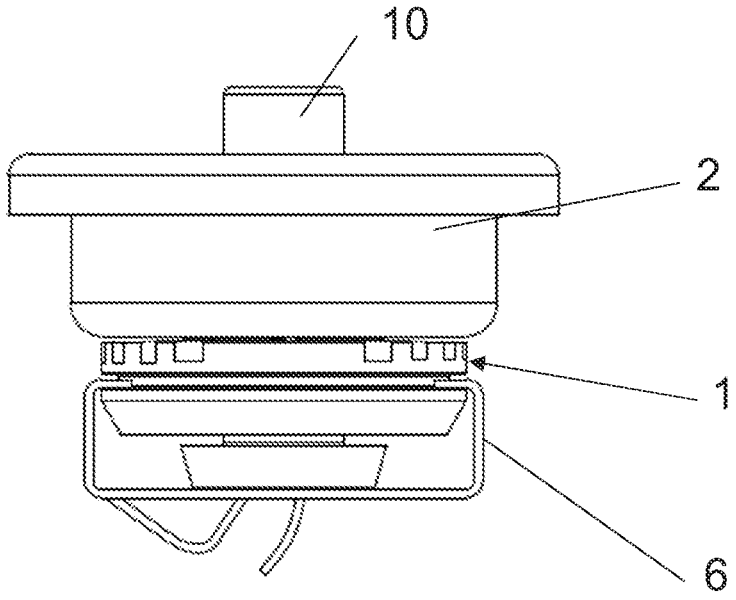
FIG. 4*a* and FIG. 4*b* show side views of the second embodiment in an open position.
Figure 4B:
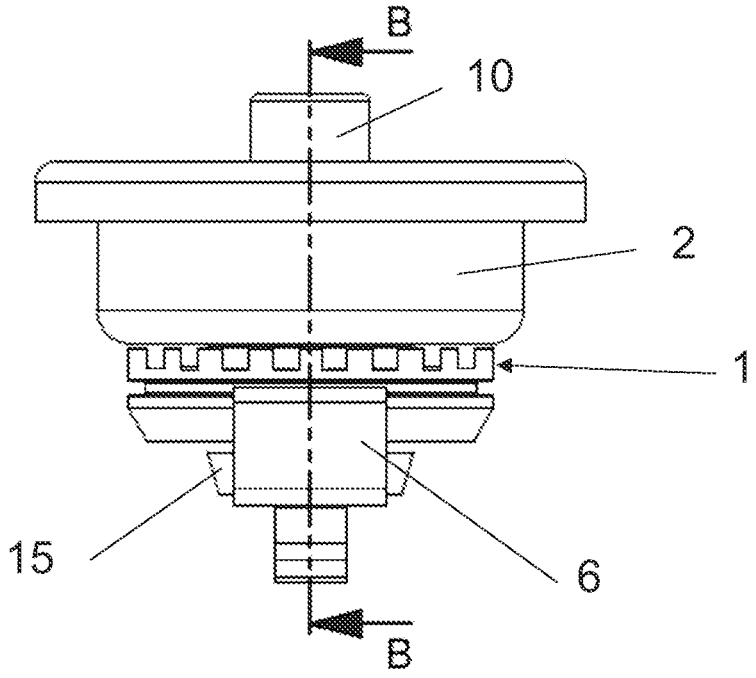
Figure 4C:
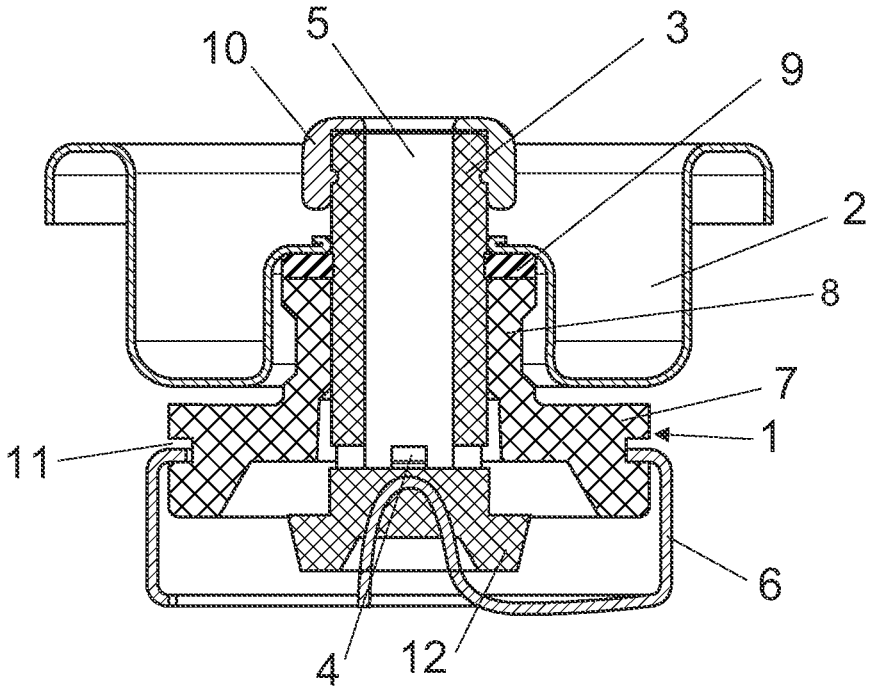
FIG. 4*c* shows a cut representation along lines B-B of FIG. 4*b* of the second embodiment in the open position.
Figure 6A:
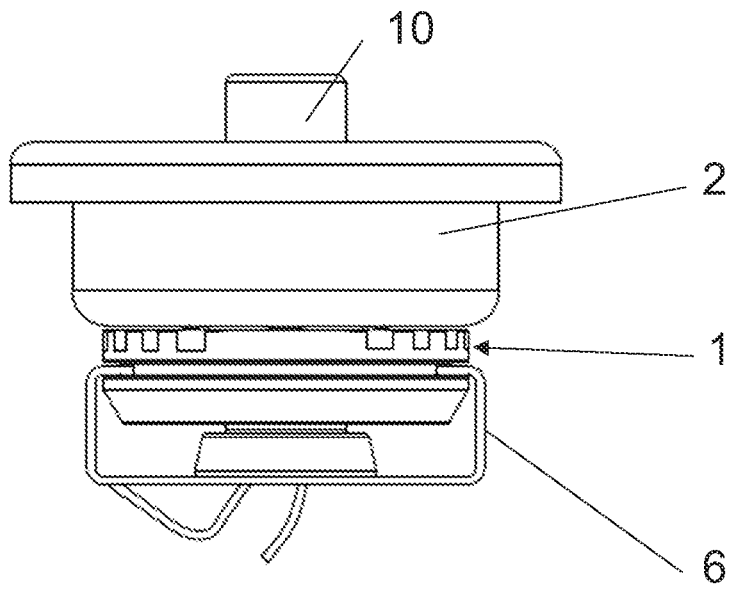
FIG. 6*a* and FIG. 6*b* show side views of the third and fourth embodiments in an open position.
Figure 6B:
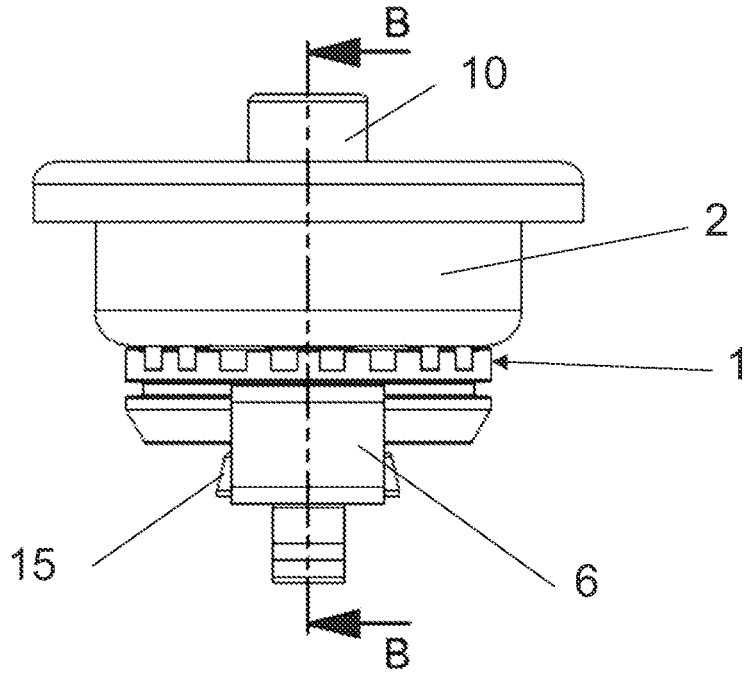
Figure 6C:
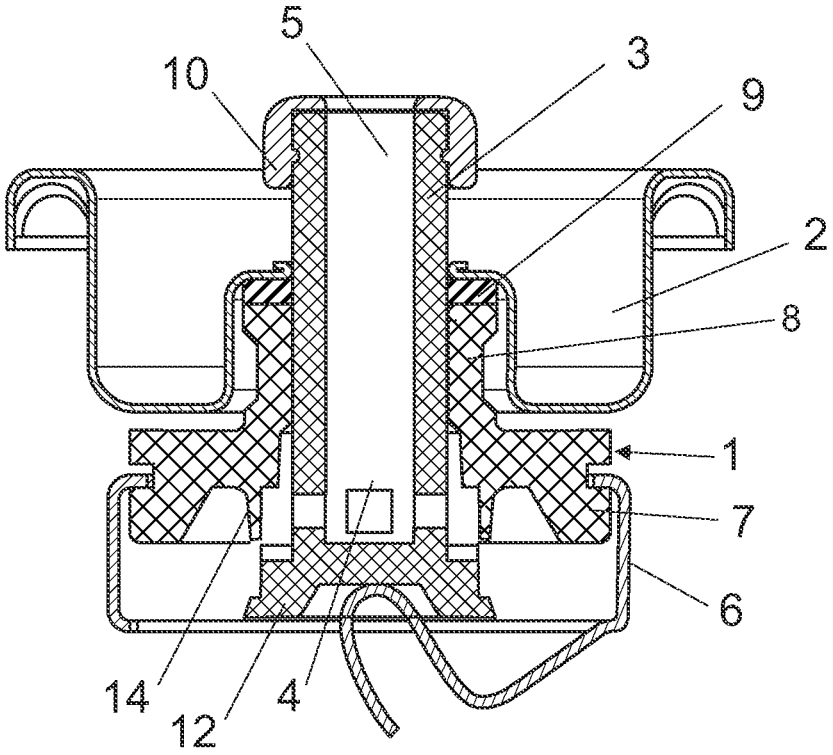
FIG. 6*c* shows a cut representation along lines B-B of FIG. 6*b* of the third and fourth embodiment ins the open position.

Means for limiting the opening distance of the valve can also be provided. Such means which limit the course of the stem to a maximum value can be a specially designed spring 15 shown in FIGS. 2*b*, 4*b*, and 6*b* which limits the opening distance of the valve and prevents the valve from being deformed.

The valves of the FIGS. 1*a*/1*b*, 3*a*/3*b* and 5*a*/5*b*. 6*a*/6*b* differ in the way the sealing between the stem 2 and the housing 1 is achieved. In all cases, the stem 3 is provided on its lower end situated in the container with a flange 12 that is pushed by the spring means 6 in the closed position against the housing thereby closing the passageway through the stem 3.

According to the embodiment shown in FIGS. 1*a*/1*b*, the flange of the stem 3 abuts in the closed position against a flat part of the housing 1 so that there is a surface contact between the flange 12 of the stem 3 and the housing 1.

Figure 3A:
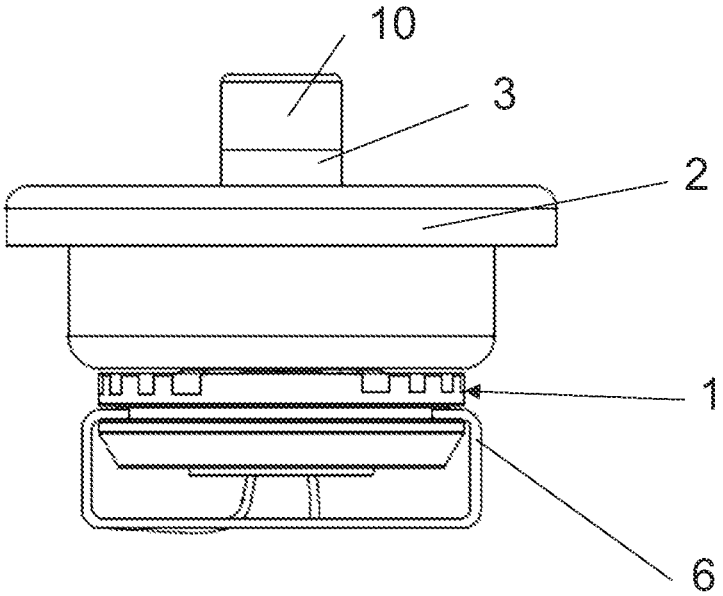
FIG. 3*a* and FIG. 3*b* show side views of a second embodiment of a valve according to the present invention in a closed position.
Figure 3B:
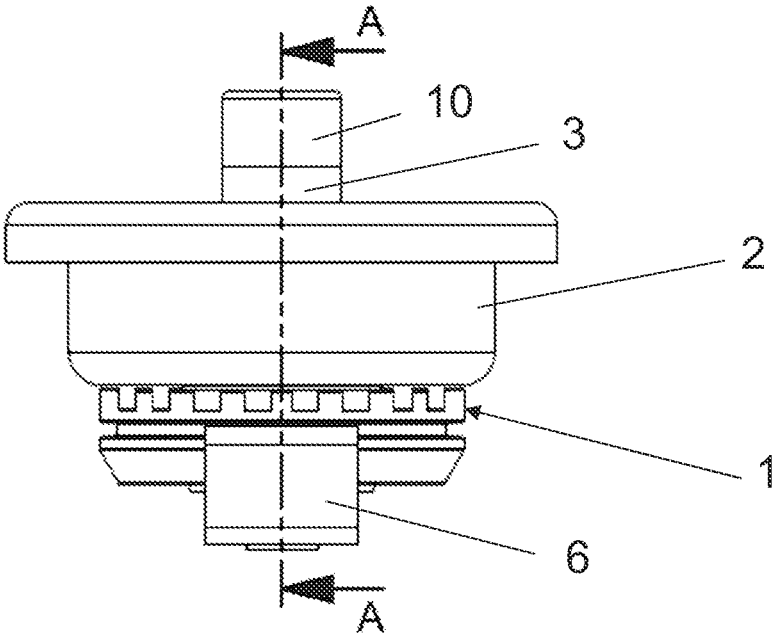
Figure 3C:
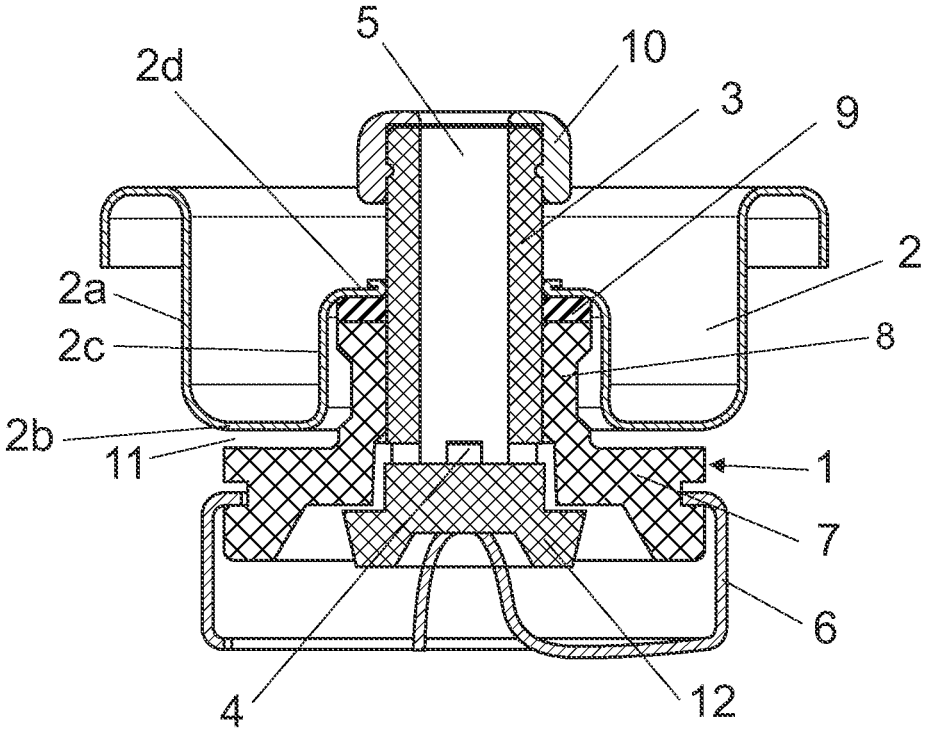
FIG. 3*c* shows a cut representation along lines A-A of FIG. 3*b* of the second embodiment in the closed position.

The embodiment of FIGS. 3*a*/3*b* differs therefrom in that a rib 13 is provided on the housing 1. The flat flange 12 of the stem 3 is pushed by the spring means 6 against the rib 13 so that there is an annular contact between the flange 12 of the stem 3 and the housing 1.

Figure 5A:
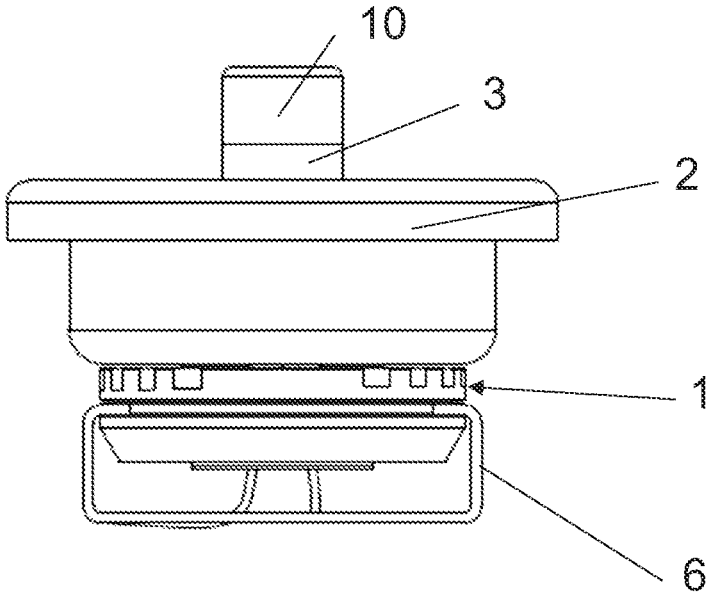
FIG. 5*a* and FIG. 5*b* show side views of third and fourth embodiments of a valve according to the present invention in a closed position.
Figure 5B:
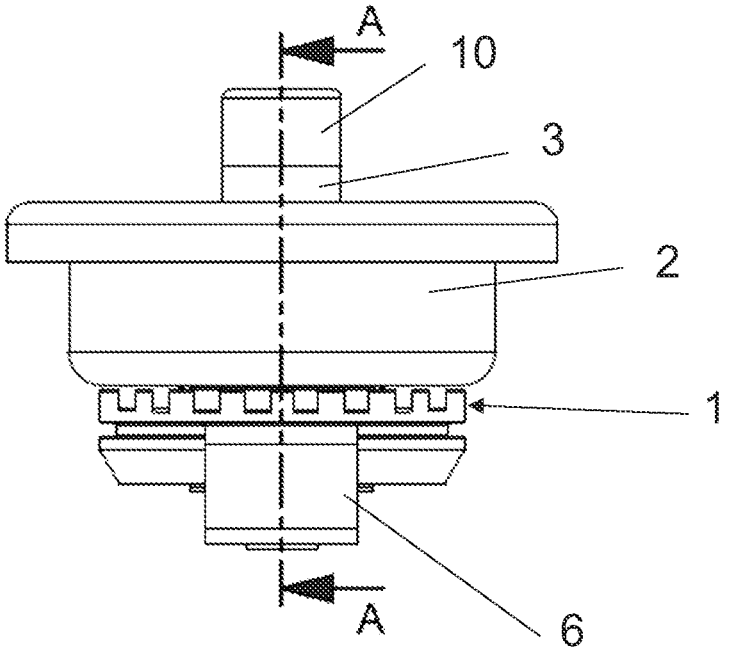
Figure 5C:
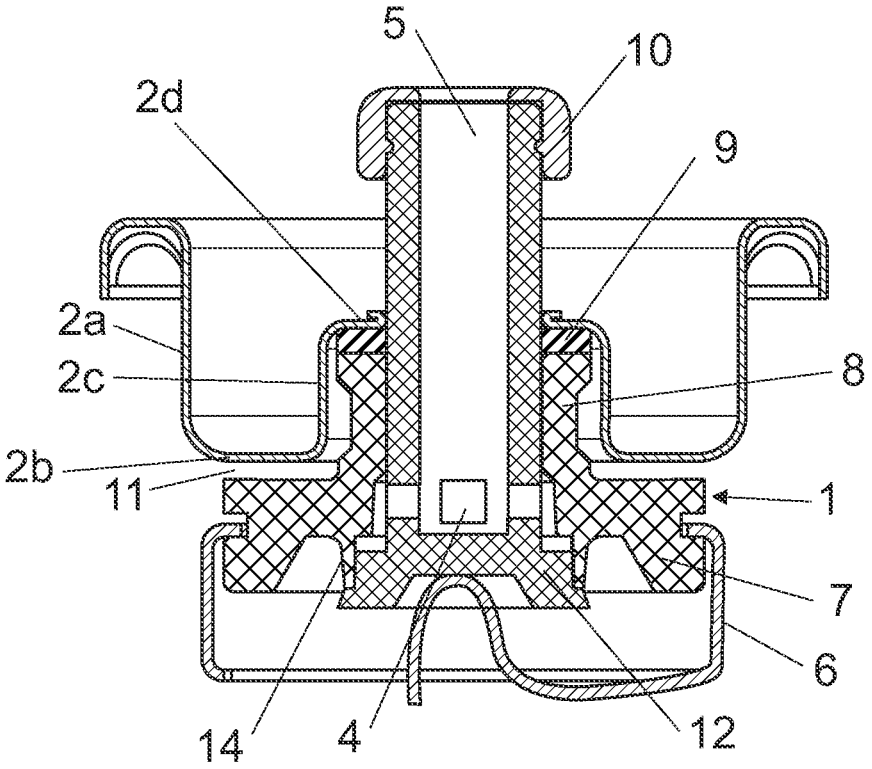
FIG. 5*c* shows a cut representation along lines A-A of FIG. 5*b* of the third and fourth embodiments in the closed position.

In the third embodiment of FIGS. 5*a*/5*b* and 6*a*/6*b*, there is also an annular contact between the stem 3 and the housing 1. In this embodiment, the flange 12 of the stem 3 has a conical shape and it abuts in the closed position against a lipseal 14 provided on the housing 1.

In the embodiments of FIGS. 3*a*/3*b*, 5*a*/5*b*, and 6*a*/6*b* the sealing surface is smaller and consequently the sealing force per surface unit is higher than for the full surface contact between the flange 12 of the stem 3 and the housing 1.

In the fourth embodiment of FIGS. 5*a*/5*b* and 6*a*/6*b*, the top sealing part 10 which is provided around the outlet opening 5 of the stem 3 is implemented in the stem 3 by two-component injection. The soft material of the top sealing part 10 is molded on the harder material of the stem 3.

The invention claimed is:

1. A valve for a container for dispensing pressurized fluid, said valve comprising a housing (1) which is mounted on a valve cup (2), a hollow stem (3) provided in a passage of the housing (1) which stem (3) has at least one lateral inlet opening (4) at a lower end of the stem and an outlet opening (5) at an upper end of the stem, which stem (3) is displaceable between a closed position and an open position and a spring element configured to push the stem (3) in the closed position, wherein the housing (1) has a circumferential step-shaped contour with a housing shape having an outer, lower part (7) and a central, upper part (8), wherein the valve cup (2) has a valve cup shape corresponding to the housing shape of the circumferential step-shaped contour of the housing along portions of the circumferential step-shaped contour of the housing having a step and ends horizontally on the top of the housing (1) close to the stem (3), and wherein a sealing (9) is provided on an upper side of the housing (1) between the housing (1) and the valve cup (2) and which seals at the same time the valve cup (2) against the housing (1) and the stem (3) against the housing (1), wherein the lower part of the housing (1) situated in the container is provided with a circumferential groove (11) in which the spring element (6) is held which pushes the stem (3) in the closed position, wherein the stem (3) is provided on the lower end of the stem situated in the container with a flange (12) that abuts in the closed position against the lower art of the housing (1) thereby closing the passageway through the stem (3).

2. The valve according to claim 1, wherein the valve cup (2) is crimped around the housing (1).

3. The valve according to claim 1, wherein the flange (12) of the stem (3) abuts in the closed position against a flat part of the housing (1).

4. The valve according to claim 1, wherein the flange (12) of the stem (3) abuts in the closed position against a circular rib (13) on the housing (1).

5. The valve according to claim 1, wherein the flange (12) of the stem (3) has a conical shaped flange (12) that abuts in the closed position against a lipseal which is located on the housing (1).

6. The valve according to claim 1, wherein a top sealing part (10) is provided around the outlet opening (5) of the stem (3).

7. The valve according to claim 1, wherein the spring element is a limiting spring and is configured to limit displacement of the valve stem in an opening position.

8. A method of dispensing, comprising:

providing the valve according to claim 1; and dispensing 1 K polyurethane foam or 2 K polyurethane foam through the valve.

* * * * *